US011640126B2

(12) United States Patent
Minamoto et al.

(10) Patent No.: US 11,640,126 B2
(45) Date of Patent: May 2, 2023

(54) IMAGE FORMING APPARATUS

(71) Applicant: KYOCERA Document Solutions Inc., Osaka (JP)

(72) Inventors: Riku Minamoto, Osaka (JP); Takashi Kusukawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/815,487

(22) Filed: Jul. 27, 2022

(65) Prior Publication Data

US 2023/0036337 A1 Feb. 2, 2023

(30) Foreign Application Priority Data

Jul. 30, 2021 (JP) ..... JP2021-125641

(51) Int. Cl.
*G03G 15/08* (2006.01)
*G03G 21/16* (2006.01)

(52) U.S. Cl.
CPC ..... *G03G 15/0886* (2013.01); *G03G 15/0868* (2013.01); *G03G 15/0872* (2013.01); *G03G 21/1633* (2013.01); *G03G 21/1647* (2013.01); *G03G 2215/0692* (2013.01); *G03G 2221/1657* (2013.01)

(58) Field of Classification Search
CPC ..... G03G 15/0868; G03G 15/0872; G03G 15/0886; G03G 21/1633; G03G 21/1647; G03G 2215/0692; G03G 2221/1657
See application file for complete search history.

(56) References Cited

U.S. PATENT DOCUMENTS

2011/0303687 A1* 12/2011 Amemiya ..... G03G 21/1633 220/662
2018/0120734 A1* 5/2018 Kitagawa ..... G03G 15/0872
2021/0389694 A1* 12/2021 Morita ..... G03G 15/0886
2022/0349230 A1* 11/2022 Tanio ..... E05D 11/1007

FOREIGN PATENT DOCUMENTS

JP 2018-017749 A 2/2018

* cited by examiner

*Primary Examiner* — Sophia S Chen
(74) *Attorney, Agent, or Firm* — Studebaker & Brackett PC

(57) ABSTRACT

An image forming apparatus includes a toner container, a storage part, a cover and an opening/closing mechanism. The toner container includes a shutter. The cover is movable between a closed position for closing the storage part and an opened position for opening the storage part. The opening/closing mechanism closes a supply port by rotating the shutter in accordance with an opening operation for moving the cover to the opened position and opens the supply port by rotating the shutter in accordance with a closing operation for moving the cover to the closed position, in a state where the toner container is attached to the storage part. The toner container includes an interference portion which interferes with the opening/closing mechanism to prevent the toner container from being attached to the storage part in a case where the cover is not moved to the opened position normally.

6 Claims, 10 Drawing Sheets

IMAGE FORMING APPARATUS

INCORPORATION BY REFERENCE

This application is based on and claims the benefit of priority from Japanese patent application No. 2021-125641 filed on Jul. 30, 2021, which is incorporated by reference in its entirety.

BACKGROUND

The present disclosure relates to an image forming apparatus provided with a detachable toner container.

In an image forming apparatus provided with a detachable toner container, a cover member turnable between an opened position for opening an attachment part of the toner container and a closed position for closing the attachment part is sometimes provided, and the opening/closing state of a shutter member of the toner container can be switched with the opening/closing operation of the cover member.

The image forming apparatus includes a rack gear which moves with the opening/closing operation of the cover member, and a gear which rotates in mesh with the rack gear and engages with the shutter member when the toner container is attached to the attachment part. When the cover member is opened, the rack gear moves in one direction to switch the shutter member to a closed state through the gear. On the other hand, when the cover member is closed, the rack gear moves in a direction opposite to one direction to switch the shutter member to an opened state through the gear.

In the image forming apparatus described above, when the toner container is attached to the attachment part while the cover member is rotated to the normal opened position, the shutter member is engaged with the gear. However, the toner container may be attached to the attachment part even when the cover member is not turned to the normal opened position, such as when the cover member is half-opened. Then, the shutter member is not engaged with the gear, and even when the cover member is turned to the closed position, the shutter member cannot be switched to the opened position, and the toner cannot be supplied from the toner container. Further, since the position of the toner container attached to the attachment part does not change between the state in which the cover member is not turned to the normal opened position and the state in which the cover member is turned to the normal opening position, it is impossible to visually confirm whether the toner container is normally attached.

SUMMARY

In accordance with one aspect of the present disclosure, an image forming apparatus includes a toner container, a storage part, a cover and an opening/closing mechanism. The toner container includes a shutter which is rotated to open and close a supply port for a toner. To the storage part, the toner container is detachably attached along a predetermined direction. The cover is movable between a closed position for closing the storage part and an opened position for opening the storage part. The opening/closing mechanism is configured to close the supply port by rotating the shutter in one direction in accordance with an opening operation for moving the cover to the opened position and to open the supply port by rotating the shutter in the other direction in accordance with a closing operation for moving the cover to the closed position, in a state where the toner container is attached to the storage part. The toner container includes an interference portion which interferes with the opening/closing mechanism to prevent the toner container from being attached to the storage part in a case where the cover is not moved to the opened position normally.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus according to one embodiment of the present disclosure will be described.

Figure 1:
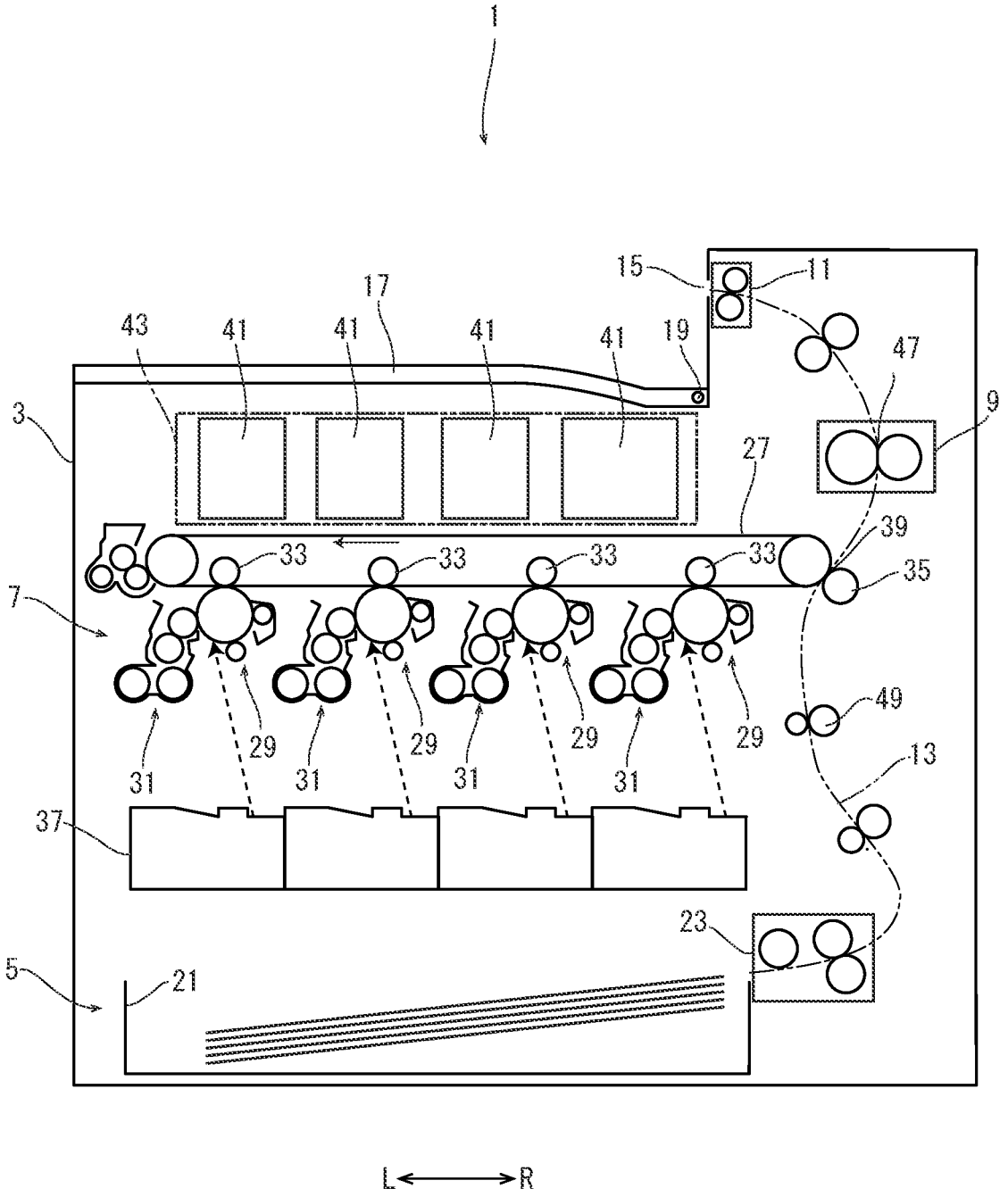
FIG. 1 is a front view schematically showing an inner structure of an image forming apparatus according to one embodiment of the present disclosure.

With reference to FIG. 1, the image forming apparatus 1 will be described. FIG. 1 is a front view schematically showing an inner structure of the image forming apparatus 1. Reference numerals L and R in each drawing indicate the left and right sides of the image forming apparatus 1, respectively.

The image forming apparatus 1 includes a housing 3 having a substantially rectangular parallelepiped hollow space. In the hollow space of the housing 3, a sheet feeding part 5, an electrophotographic type image forming part 7, a fixing device 9, and a discharge device 11 are stored. Further, in the hollow space of the housing 3, a main conveyance path 13 along which a sheet is conveyed from the sheet feeding part 5 to the discharge device 11 via the image forming part 7 and the fixing device 9 is provided.

The top plate of the housing 3 is provided with a sheet discharge port 15 and a sheet discharge tray 17. The discharge tray 17 is supported in a turnable manner around a turning shaft 19 provided below the discharge port 15. The hollow space of the housing 3 is opened by turning the discharge tray 17 upward.

The sheet feeding part 5 is disposed in the lower portion of the hollow space, and includes a sheet feeding cassette 21 in which the sheet is stored, and a sheet feeding device 23 which feeds the sheet from the sheet feeding cassette 21 to the main conveyance path 13.

The image forming part 7 is disposed above the sheet feeding part 5, and includes an endless intermediate transfer belt 27, four image carrier units 29 and four developing units 31 corresponding to toners of four colors (yellow, magenta, cyan and black), four primary transfer rollers 33 corresponding to the four image carrier units 29, a secondary transfer roller 35, and an exposure device 37.

The intermediate transfer belt 27 is wound around a driving roller and a driven roller which are disposed apart from each other in the left-and-right direction. As the driving roller rotates, the intermediate transfer belt 27 travels in the counterclockwise direction of FIG. 1.

The four image carrier units 29 are disposed side by side along the traveling direction of the intermediate transfer belt 27 so as to face the lower track of the intermediate transfer belt 27. Each of the four developing units 31 is disposed on the upstream side of corresponding image carrier unit 29 in the traveling direction of the intermediate transfer belt 27. The four primary transfer rollers 33 are disposed in the hollow space of the intermediate transfer belt 27, and face the four image carrier units 29 across the intermediate transfer belt 27. The secondary transfer roller 35 is disposed facing the intermediate transfer belt 27 on the downstream side of the four image carrier units 29 and the four developing units 31 in the traveling direction of the intermediate transfer belt 27. A transfer nip 39 is formed between the secondary transfer roller 35 and the intermediate transfer belt 27.

The exposure device 37 is disposed below the four image carrier units 29 and the four developing units 31, and exposes the four image carrier units 29 based on image data.

Each of the four developing units 31 is connected to a toner container 41 containing the toner of corresponding color. The four toner containers 41 are stored in a container storage part 43 provided in the housing 3. The container storage part 43 is provided above the intermediate transfer belt 27 and below the discharge tray 17. The container storage part 43 is opened by turning the discharge tray 17 upward. The toner container 41 is detachably attached to the container storage part 43 along the attaching/detaching direction along the upper-and-lower direction. As described above, the discharge tray 17 is an example of a cover which opens and closes the container storage part 43. When the toner container 41 is attached to the container storage part 43, the toner container 41 can communicate with the corresponding developing unit 31. The toner container 41 and the container storage part 43 will be described later.

The fixing device 9 is disposed above the transfer nip 39, and includes a pressing roller and a heating roller, and a fixing nip 47 is formed between both rollers. The discharge device 11 is disposed above the fixing device 9 and inside the discharge port 15.

The main conveyance path 13 is formed from the sheet feeding device 23 of the sheet feeding part 5 to the discharge device 11 through the transfer nip 39 and the fixing nip 47. On the main conveyance path 13, a registration rollers pair 49 is disposed between the sheet feeding device 23 and the transfer nip 39.

Next, the image forming operation will be briefly described. In the image forming part 7, the image carrier units 29 form electrostatic latent images corresponding to the image data by the exposing by the exposure device 37. The developing units 31 develop the electrostatic latent images formed on the image carrier units 29 into toner images. The toner image of each image carrier unit 29 is transferred to the intermediate transfer belt 27 by the corresponding primary transfer roller 33.

On the other hand, in the sheet feeding part 5, the sheet is conveyed from the sheet feeding cassette 21 to the main conveyance path 13 by the sheet feeding device 23. The sheet is conveyed to the transfer nip 39 by the registration rollers pair 49 at appropriate timing. At the transfer nip 39, the toner images formed on the intermediate transfer belt 27 are transferred to the sheet. The sheet is conveyed to the fixing device 9 along the main conveyance path 13, and the toner image is fixed to the sheet at the fixing nip 47. The sheet is further conveyed to the discharge device 11, and is discharged to the discharge tray 17 through the discharge port 15 by the discharge device 11.

Figure 2:
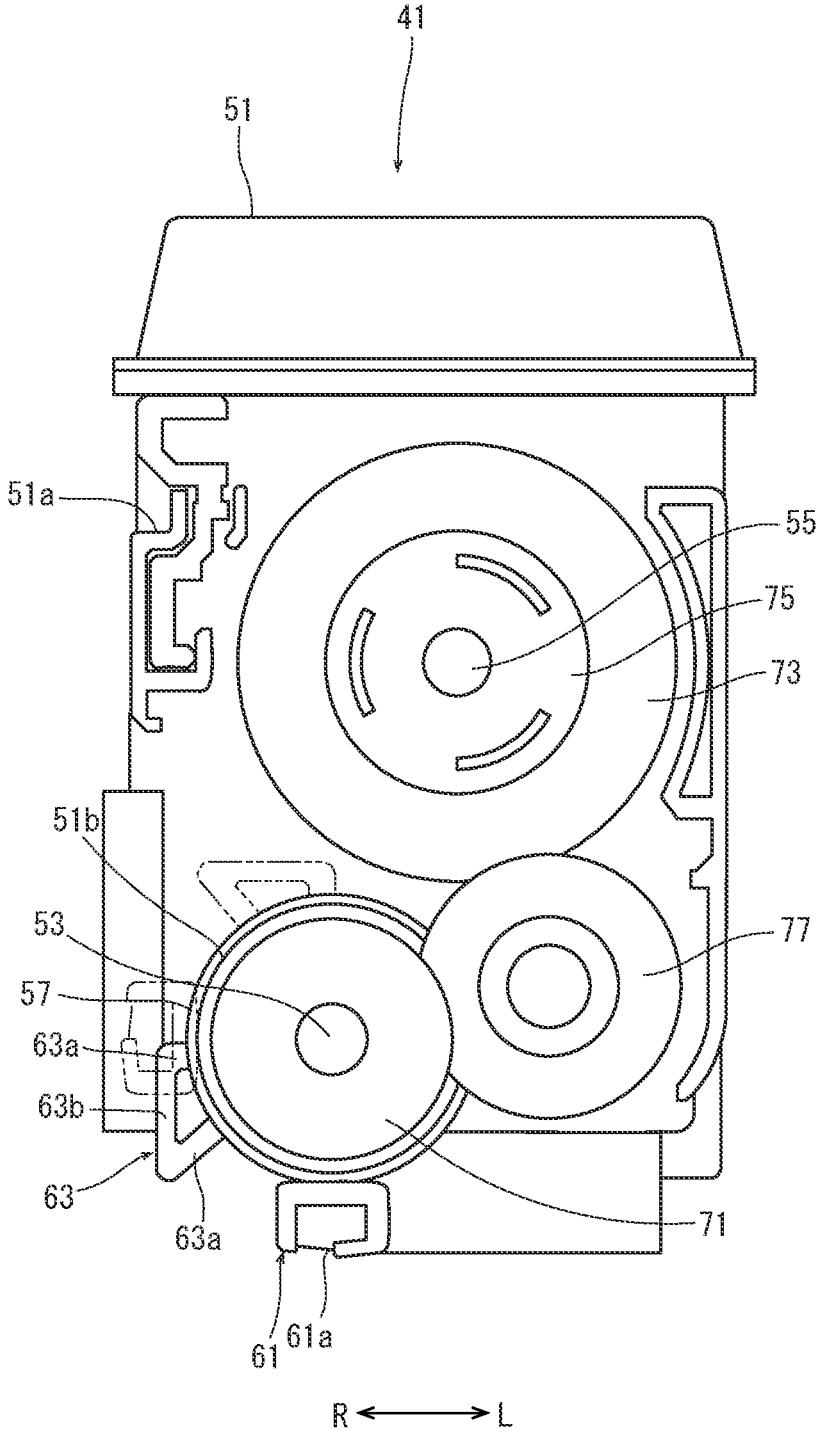
FIG. 2 is a view showing a toner container of the image forming apparatus according to the embodiment of the present disclosure, when viewed from the rear side.

Next, the toner container 41 will be described with reference to FIG. 2. FIG. 2 is a view showing the toner container 41 viewed from the rear side.

The toner container 41 includes a substantially rectangular parallelepiped housing 51 having a hollow space long in the front-and-rear direction, and a supply screw 53 and an agitating paddle 55 which are housed in the housing 51. The rear side plate of the housing 51 is formed with a recess 51*a* recessed inward along a direction (the left-and-right direction) intersecting the attaching/detaching direction (the upper-and-lower direction).

The housing 51 has a cylindrical duct 51*b* protruding rearward from the lower portion of the rear side plate. On the lower surface of the duct 51*b*, a supply port (not shown) through which the toner is supplied to the developing unit 31 is formed. A cylindrical shutter 57 is rotatably supported around the duct 51*b*. A communication port (not shown) is formed in the shutter 57 along the circumferential direction. By rotating the shutter 57 to communicate the communication port with the supply port of the duct 51*b*, the toner can be supplied to the developing unit 31 through the supply port and the communication port.

On the outer circumferential surface of the shutter 57, an engagement protrusion 61 and an interference protrusion 63 are formed at an interval in the circumferential direction. As an example, the engagement protrusion 61 and the interference protrusion 63 are spaced apart at a center angle of about 70 degrees with respect to the center of the shutter 57. The engagement protrusion 61 has a rectangular cylindrical shape long in the circumferential direction of the shutter 57 when viewed from the rear side. The engagement protrusion 61 has a slit 61*a* formed along the axial direction of the shutter 57. The interference protrusion 63 has a substantially trapezoidal cylindrical shape long in the circumferential direction of the shutter 57 when viewed from the rear side, and has two leg portions 63*a* along the radial direction of the shutter 57 and an outer circumferential portion 63*b* connecting the two leg portions 63*a*. The length of the leg portion 63*a* on the side close to the engagement protrusion 61 is longer than the length of the other leg portion 63*a*.

The engagement protrusion 61 is disposed at a position different from the communication port in the circumferential direction. As an example, the engagement protrusion 61 and the communication port are spaced apart at a center angle of about 90 degrees with respect to the center of the shutter 57. Therefore, as shown in FIG. 2, when the shutter 57 is rotated so that the engagement protrusion 61 protrudes directly downward, the communication port of the shutter 57 does not communicate with the supply port of the duct 51*b*, and the toner is not supplied. The posture of the shutter 57 at this time (see the solid line in FIG. 2) is referred to as a closed posture.

When the shutter 57 is rotated in the closed posture, the interference protrusion 63 protrudes outward (rearward) from the duct 51*b*, and the outer circumferential portion 63*b* extends along the upper-and-lower direction. On the other hand, when the shutter 57 rotated in the closed posture is rotated by about 90 degrees in the clockwise direction of FIG. 2, the communication port of the shutter 57 communicates with the supply port of the duct 51*b*, so that the toner can be supplied. The posture of the shutter 57 at this time (refer to the two-dot chain line in FIG. 2) is referred to as an opened posture. When the shutter 57 rotates in the opened posture, the interference protrusion 63 protrudes upward from the duct 51*b*. As described above, the interference protrusion 63 is disposed on the downstream of the engagement protrusion 61 in the rotating direction of the shutter 57 from the closed posture to the opened posture.

The front end of the supply screw 53 is rotatably supported by the front side plate of the housing 51, and the rear end protrudes rearward from the rear side plate of the duct 51*b*. A first gear 71 is fixed to the rear end of the supply screw 53 protruding from the rear side plate of the duct 51*b*.

The agitating paddle 55 is disposed above the supply screw 53. The front end of the agitating paddle 55 is rotatably supported by the front side plate of the housing 51, and the rear end protrudes rearward from the rear side plate of the housing 51. A second gear 73 is fixed to the rear end of the agitating paddle 55 protruding from the rear side plate of the housing 51. On the rear side surface of the second gear 73, a container side coupling 75 is fixed coaxially with the supply screw 53. The container side coupling 75 has three coupling pieces disposed at predetermined intervals along the rotating direction of the agitating paddle 55.

The first gear 71 and the second gear 73 are connected through an idle gear 77. When the second gear 73 is rotated, the agitating paddle 55 is rotated to agitate the toner in the housing 51. When the second gear 73 is rotated, the first gear 71 is rotated through the idle gear 77 to rotate the supply screw 53. As a result, the toner in the housing 51 is conveyed toward the supply port.

Figure 3:
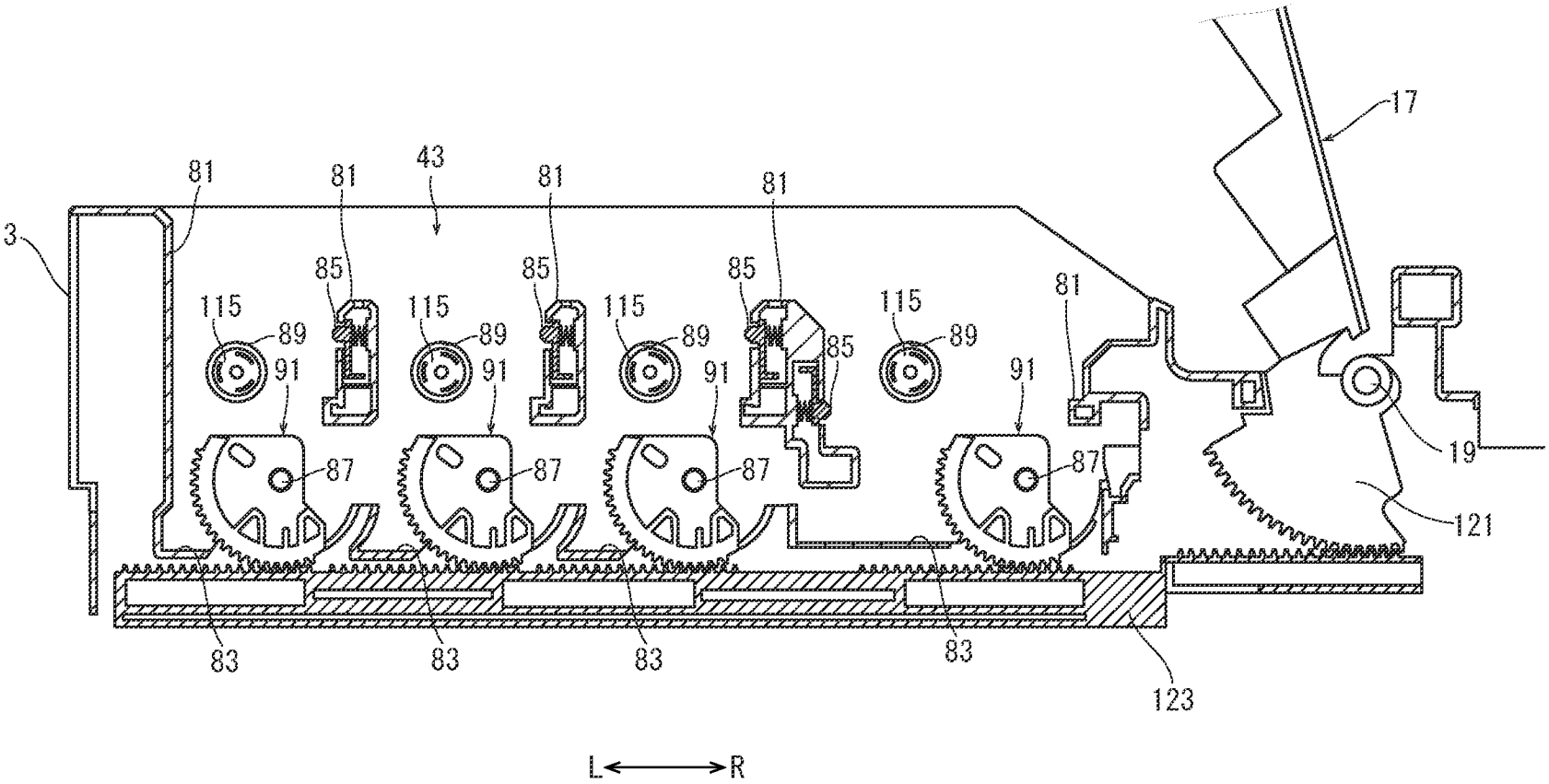
FIG. 3 is a front view showing a container storage part (in a state where a discharge tray is turned to a closed position) of the image forming apparatus according to the embodiment of the present disclosure.
Figure 4:
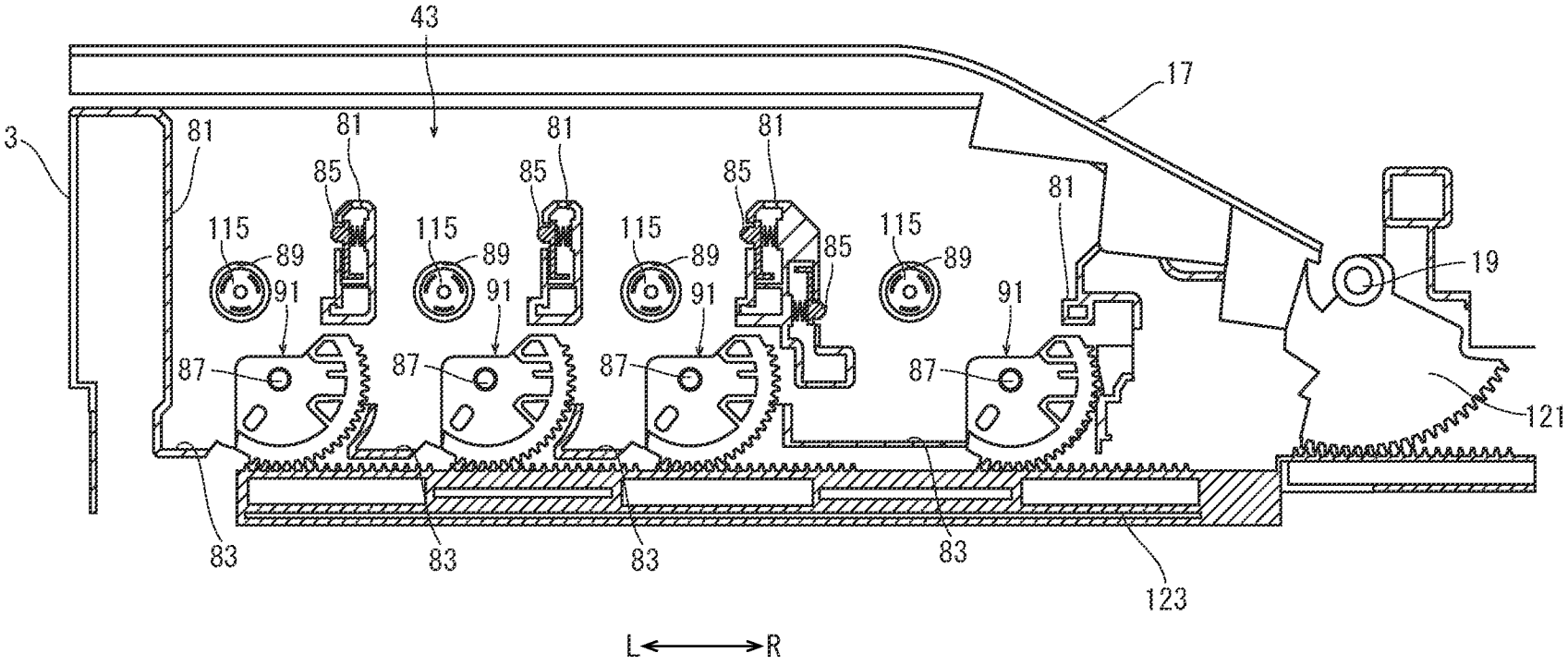
FIG. 4 is a front view showing the container storage part (in a state where the discharge tray is turned to an opened position) of the image forming apparatus according to the embodiment of the present disclosure.

Next, the container storage part 43 will be described with reference to FIG. 3 and FIG. 4. FIG. 3 and FIG. 4 are front views showing the rear container storage part 43.

As described above, the container storage part 43 is provided in the front side plate and the rear side plate of the housing 3 above the intermediate transfer belt 27 (see FIG. 1). In each of the front side plate and the rear side plate of the housing 3, five guide protrusions 81 and a stepped portion 83 are provided. The five guide protrusions 81 are formed along the upper-and-lower direction, and disposed at intervals in the left-and-right direction. The stepped portion 83 extends along the left-and-right direction below the guide protrusions 81. The front stepped portion 83 is formed to protrude into the hollow space of the housing 3 by recessing the front side plate toward the rear side, and the rear stepped portion 83 is formed to protrude into the hollow space of the housing 3 by recessing the rear side plate toward the front side. The stepped portion 83 below the two adjacent guide protrusions 81 are formed to correspond to the shape of the bottom portion of the housing 51 of the toner container 41.

Four individual storage parts for storing the four toner containers 41 are formed side by side in the left-and-right direction by the two adjacent guide protrusions 81 and the stepped portion 83 below the two guide protrusions 81. In one guide protrusion 81 of each individual storage part, a lock member 85 which positions the toner container 41 is supported in a movable manner along the left-and-right direction intersecting the attaching/detaching direction (the upper-and-lower direction). Each lock member 85 is biased by a spring in a direction protruding to the individual storage part.

The toner container is guided in the attaching/detaching direction by the guide protrusions 81 adjacently disposed in the left-and-right direction, and the front and rear ends of the housing 51 are placed on the front and rear stepped portions 83, so that the toner container 41 is attached to the individual storage part. When the toner container 41 is attached to the individual storage part, the lock member 85 of the guide protrusion 81 is engaged with the recess 51*a* (see FIG. 2) of the toner container 41, and the toner container 41 is positioned in the corresponding individual storage part.

In each of the individual storage parts, the rear side plate has a support shaft 87 protruding above the stepped portion 83 and a circular opening 89 formed above the support shaft 87. An opening/closing gear 91 is supported on the support shaft 87. A drive side coupling 115 is supported in the opening 89.

Figure 5:
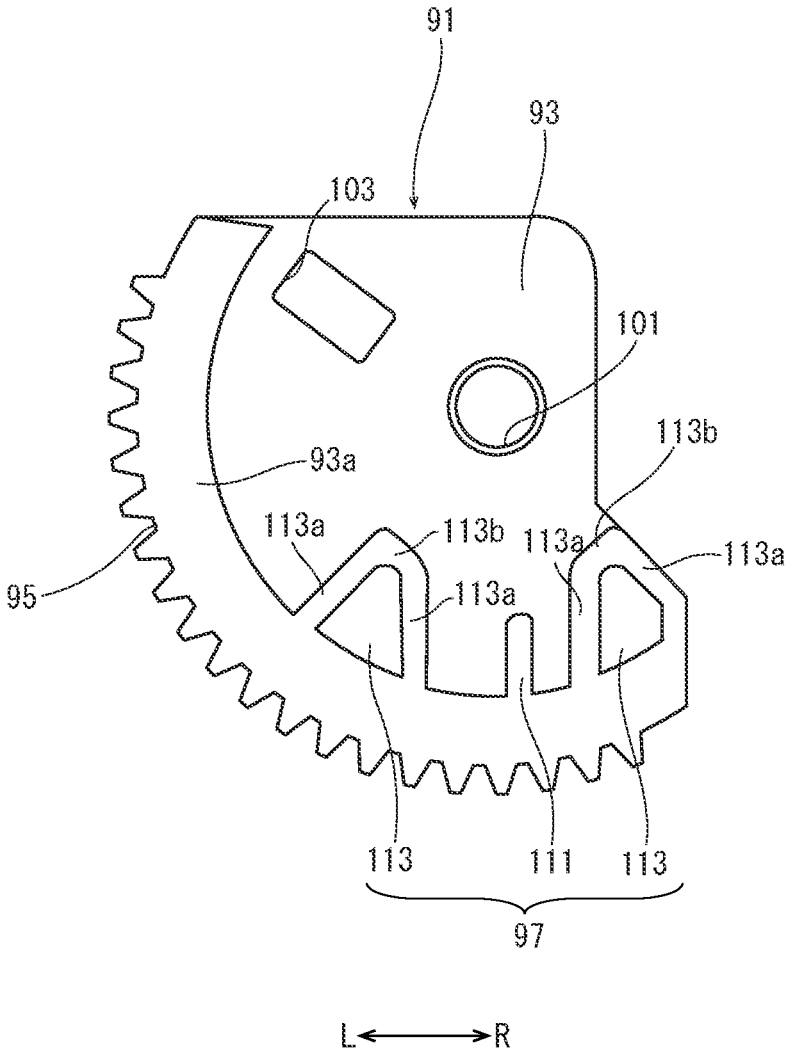
FIG. 5 is a front view showing an opening/closing gear in the image forming apparatus according to the embodiment of the present disclosure.

First, the opening/closing gear 91 will be described with reference to FIG. 5. FIG. 5 is a view showing the opening/closing gear 91 when viewed from the front side. The opening/closing gear 91 is a substantially fan-shaped member when viewed from the front side, and has a flat plate portion 93, a gear portion 95 and an engagement protrusion 97 which are provided on the flat plate portion 93.

The flat plate portion 93 has a substantially fan-shaped shape when viewed from the front side. A shaft hole 101 through which the support shaft 87 is inserted is formed in the vicinity of the center of the substantially fan-shape. Further, a substantially rectangular opening 103 is formed in the flat plate portion 93 on one end side in the circumferential direction. Around the outer circumference of the flat plate portion 93, an outer circumferential wall 93*a* is formed along the circumferential direction around the shaft hole 101.

The gear portion 95 is formed around the outer circumferential surface of the outer circumferential wall 93*a* of the flat plate portion 93. As an example, the gear portion 95 is formed within a range of a center angle of about 90 degrees around the shaft hole 101. The engagement protrusion 97 is formed on the inner circumferential surface of the outer circumferential wall 93*a* of the flat plate portion 93. The engagement protrusion 97 is formed on the side opposite to the opening 103 in the circumferential direction. The engagement protrusion 97 has an engagement piece 111 and a pair of guide pieces 113 disposed on both sides of the engagement piece 111 in the circumferential direction. The engagement piece 111 is formed linearly along the radial direction of the shaft hole 101. Each of the guide pieces 113 has a substantially trapezoidal cylindrical shape long in the circumferential direction when viewed from the front side, and has a length (height) along the radial direction longer than that of the engagement piece 111. Each guide piece 113 has two leg portions 113*a* and an outer circumferential portion 113*b* connecting the two leg portions 113*a*. The leg portions 113*a* on the side closer to the engagement piece 111 are formed in parallel with the engagement piece 111, and the leg portions 113*a* on the side farther from the engagement piece 111 are formed along the radial direction.

As shown in FIG. 3 and FIG. 4, the opening/closing gear 91 is rotatably supported by the support shaft 87 protruding from the rear side plate, and rotates in accordance with the opening/closing operation of the discharge tray 17.

A drive gear 121 is provided around the turning shaft 19 of the discharge tray 17. The drive gear 121 is a fan-shaped gear, and rotates around the turning shaft 19 together with the turning shaft 19. That is, the drive gear 121 rotates in accordance with the opening/closing operation of the discharge tray 17.

A rack gear 123 is supported below the stepped portion 83 of the rear side plate so as to be movable along the horizontal direction. One end of the rack gear 123 is meshed with the drive gear 121. The rack gear 123 is meshed with the gear portion 95 (see FIG. 5) of the opening/closing gear 91 supported by each individual storage part through a slit (not shown) formed on the bottom portion of the stepped portion 83. Thus, when the drive gear 121 is rotated in accordance with the opening/closing operation of the discharge tray 17, the rack gear 123 is moved along the horizontal direction, and the opening/closing gears 91 are rotated.

More specifically, as shown in FIG. 3, when the discharge tray 17 is turned to the opened position, the rack gear 123 is moved to the leftmost position, and the opening/closing gear 91 is rotated so that the engagement piece 111 of the engagement protrusion 97 faces downward. The posture of the opening/closing gear 91 at this time is referred to as an initial posture. When the discharge tray 17 is rotated from the opened position to the closed position, the drive gear 121 is rotated in the counterclockwise direction in FIG. 3, and the rack gear 123 is moved in the right direction. Thus, the opening/closing gear 91 is rotated in the counterclockwise direction of FIG. 3. As shown in FIG. 4, when the discharge tray 17 is turned to the opened position, the opening/closing gear 91 is rotated around the support shaft 87 by about 90 degrees from the initial posture. The posture of the opening/closing gear 91 at this time is referred to as a rotated posture. Thus, the opening/closing gear 91 is rotated from the initial posture to the turned posture by the closing operation in which the discharge tray 17 is turned from the opened position to the closed position, and the opening/closing gear 91 is rotated from the turned posture to the initial posture by the opening operation in which the discharge tray 17 is turned from the closed position to the open position.

Figure 6A:
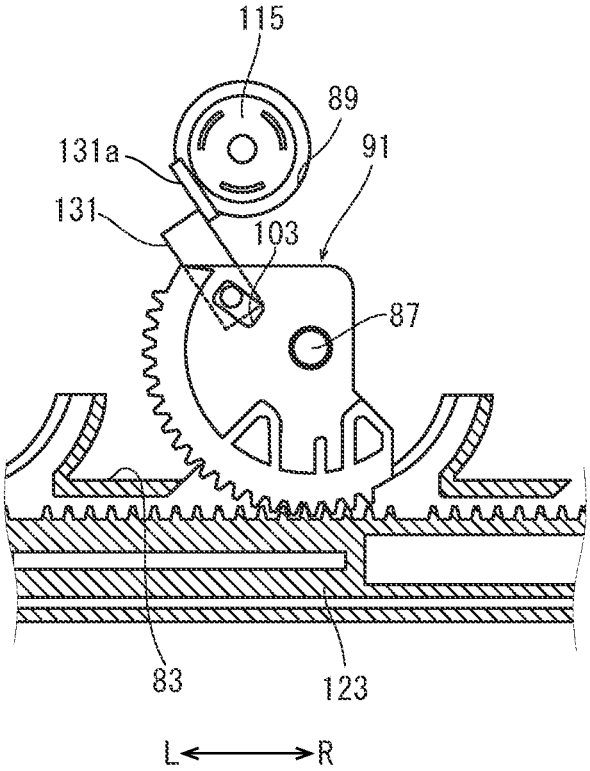
FIG. 6A is a view showing a link member coupling the opening/closing gear to a body side coupling (in the state where the discharge tray is turned to the opened position) in the image forming apparatus according to the embodiment of the present disclosure.
Figure 6B:
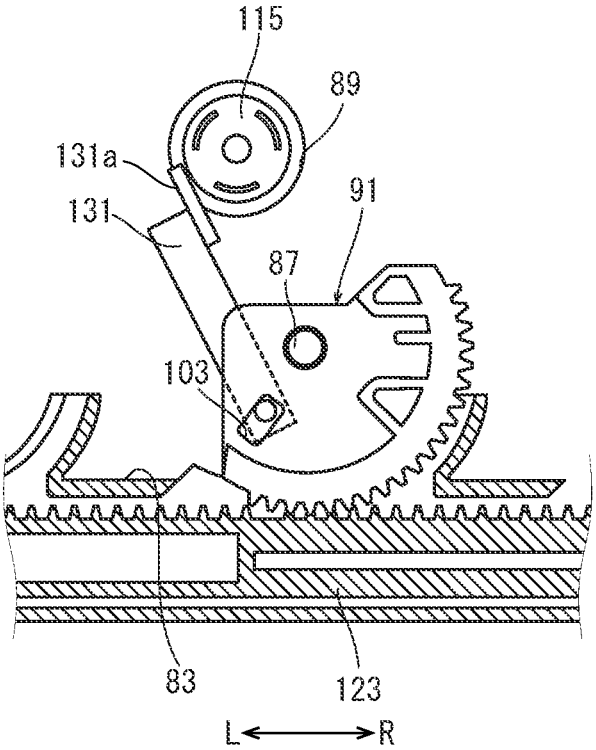
FIG. 6B is a view showing the link member coupling the opening/closing gear to the body side coupling (in the state where the discharge tray is turned to the closed position) in the image forming apparatus according to the embodiment of the present disclosure.

Next, the drive side coupling 115 will be described with reference also to FIG. 6A and FIG. 6B. FIG. 6A and FIG. 6B are views showing the drive side coupling 115 and the opening/closing gear 91 when viewed from the front side. The drive side coupling 115 is a cylindrical member, and three coupling pieces along the circumferential direction are formed on one end surface. The three coupling pieces are arranged at predetermined intervals along the circumferential direction. The drive side coupling 115 is connected to a drive source (not shown) disposed in the housing 3, and is rotatable in a predetermined direction. The drive side coupling 115 is supported so as to be movable in the front-and-rear direction between a coupling position protruding to the hollow space of the housing 3 (the container storage part 43) through the opening 89 of the rear side plate, and a non-coupling position retreating from the hollow space of the housing 3, in a posture where the end surface on which the coupling pieces are formed faces forward.

The drive side coupling 115 is biased toward the coupling position, and rotatably stored in a cylindrical cam member (not shown). A cam is formed around the inner circumferential surface of the cam member, and a gear is formed around the outer circumferential surface along the circumferential direction. The cam member is rotatably supported by a bush (not shown) fixed to the opening 89 of the rear side plate. A cam follower with which the cam of the cam member is engaged is formed in the bush. When the cam member is rotated, the cam of the cam member is guided by the cam follower of the bush, and the cam member moves in the front-and-rear direction. As a result, the drive side coupling 115 moves together with the cam member to the coupling position and to the non-coupling position.

When the drive side coupling 115 is moved to the coupling position while the toner container 41 is stored in each individual storage part of the container storage part 43, the drive side coupling 115 is engaged with the container side coupling 75 (see FIG. 2) of the toner container 41. By engaging the drive side coupling 115 with the container side coupling 75 in this manner, the rotating of the drive side coupling 115 is transmitted to the second gear 73. This permits the agitating paddle 55 and the supply screw 53 rotating. On the other hand, when the drive side coupling 115 is moved to the non-coupling position, the engagement of the drive side coupling 115 with the container side coupling 75 is released.

The cam member and the opening/closing gear 91 are connected by a link member 131 as shown in FIG. 6A and FIG. 6B. One end of the link member 131 is rotatably connected to the opening 103 formed in the flat plate portion 93 of the opening/closing gear 91. A rack gear 131*a* meshing with the gear of the cam member is formed at the other end of the link member 131.

As described above, when the rack gear 123 is moved in accordance with the opening/closing operation of the discharge tray 17 and the opening/closing gear 91 is rotated, the cam member rotates through the link member 131. As shown in FIG. 6A, in a state where the discharge tray 17 is turned to the opened position and the opening/closing gear 91 is rotated to the initial posture, the cam member is moved most rearward along the bush by the link member 131, and the drive side coupling 115 is moved to the non-coupling position. As shown in FIG. 6B, when the discharge tray 17 is turned to the closed position and the opening/closing gear 91 is rotated to the turned posture, the cam member is moved most forward along the bush by the link member 131, and the drive side coupling 115 is moved to the coupling position.

Figure 7:
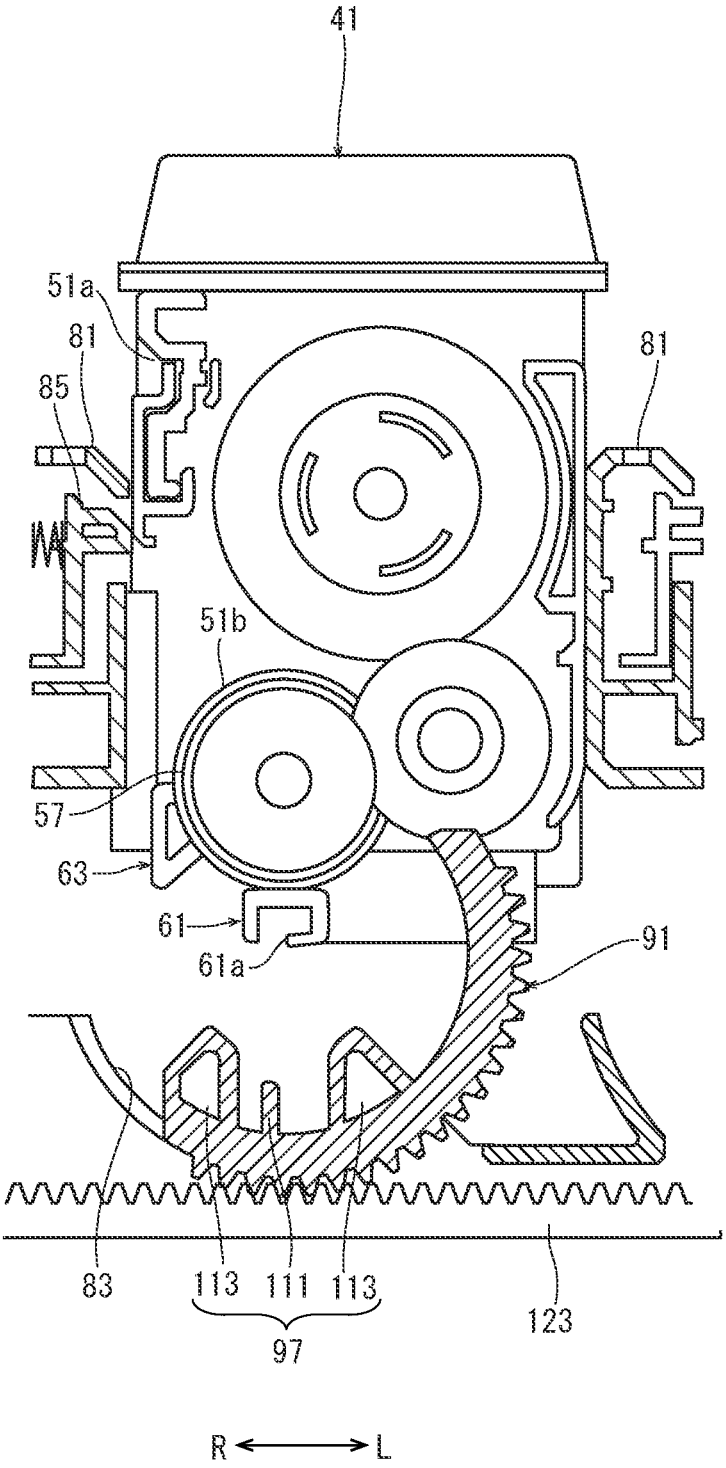
FIG. 7 is a view showing the toner container in a middle of attaching to the container storage part, in the image forming apparatus according to the embodiment of the present disclosure.
Figure 8A:
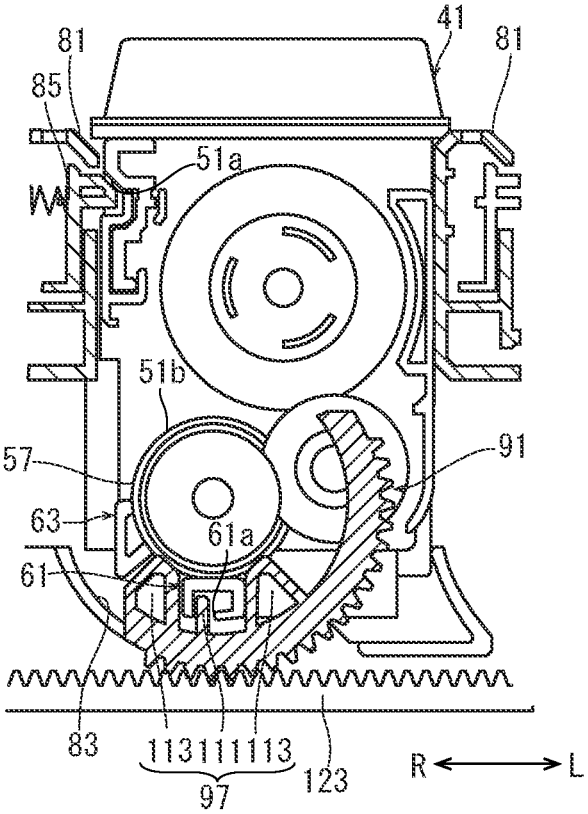
FIG. 8A is a view showing a state where an engagement protrusion of the toner container is engaged with an engagement protrusion of the opening/closing gear, in the image forming apparatus according to the embodiment of the present disclosure.
Figure 8B:
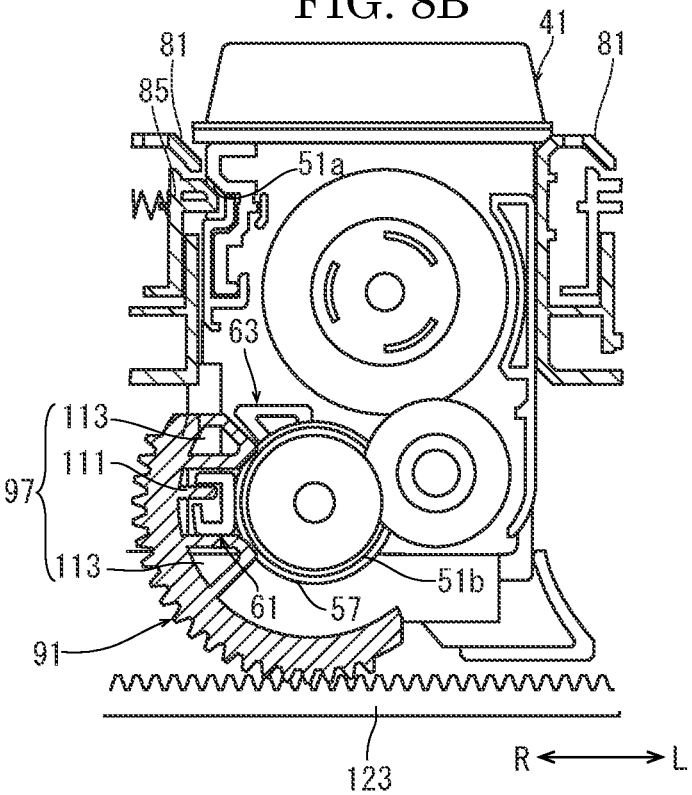
FIG. 8B is a view showing a state where a skitter of the toner container is turned to an opened position, in the image forming apparatus according to the embodiment of the present disclosure.

The attaching operation of the toner container 41 in the image forming apparatus 1 having the above configuration will be described with reference to FIG. 3, FIG. 4, FIG. 7, FIG. 8A and FIG. 8B. FIG. 7, FIG. 8A and FIG. 8B are views showing the toner container 41 when viewed from the rear side. The shutter 57 of the toner container 41 is rotated in the closed posture.

When the toner container 41 is attached, as shown in FIG. 3, the discharge tray 17 is turned to the opened position to open the container storage part 43. The rack gear 123 is moved to the leftmost position, and the opening/closing gear 91 is rotated to the initial posture. That is, as shown in FIG. 7, the opening/closing gear 91 is rotated so that the engagement piece 111 of the engagement protrusion 97 protrudes directly downward. The guide pieces 113 are respectively positioned on both sides of the engagement piece 111. Spaces along the upper-and-lower direction are formed between the engagement piece 111 and both guide pieces 113. The drive side coupling 115 is moved to the non-coupling position.

As shown in FIG. 7, the toner container 41 is inserted downward along the adjacent guide projections 81 of the corresponding individual storage part. At this time, the lock member 85 supported by the guide protrusion 81 is pushed into the guide protrusion 81 against the biasing force of the spring by the housing 51 of the toner container 41.

As the toner container 41 is inserted downward, as shown in FIG. 8A, the engagement protrusion 61 of the shutter 57 is engaged with the engagement protrusion 97 of the opening/closing gear 91. Specifically, the engagement piece 111 of the opening/closing gear 91 enters the slit 61*a* of the engagement protrusion 61 of the shutter 57. At this time, the engagement protrusion 61 of the shutter 57 is guided downward along both guide pieces 113 of the opening/closing gear 91, and is fitted between both guide pieces 113. Alternatively, one guide piece 113 of the opening/closing gear 91 is fitted between the engagement protrusion 61 and the interference projection 63 of the shutter 57. As a result, the shutter 57 and the opening/closing gear 91 are engaged with each other, and the front and rear ends of the housing 51 of the toner container 41 are placed on the stepped portions 83 of the front and rear side plates. Further, the lock member 85 is biased by the spring to engage with the recess 51*a*. As a result, the toner container 41 is attached to the individual storage part. When the engagement piece 111 enters the slit 61*a*, the engagement piece 111 of the opening/closing gear 91 is slightly elastically deformed, and a load is applied to the user by the friction between them. When the engagement piece 111 is completely inserted into the slit 61*a*, the engagement piece 111 of the opening/closing gear 91 is elastically returned to give the user a click feeling.

After the toner container 41 is attached, the discharge tray 17 is turned to the closed position. Then, the rack gear 123 is moved and the opening/closing gear 91 is rotated. Thus, the shutter 57 engaged with the opening/closing gears 91 rotates along the duct 51*b*. When the discharge tray 17 is fully turned to the closed position, the opening/closing gear 91 is rotated to the turned posture, as shown in FIG. 8B. Then, the shutter 57 is rotated to the opened posture together with the opening/closing gear 91. Thus, the communication port of the shutter 57 communicates with the supply port of the duct 51*b*, and the toner can be supplied through the supply port. As described above, the opening/closing gear 91 and the rack gear 123 constitute an opening/closing mechanism which closes the supply port by rotating the shutter 57 in one direction in accordance with the opening operation of the discharge tray 17, and opens the supply port by rotating the shutter 57 in the other direction in accordance with the closing operation of the discharge tray 17.

Further, with the rotating of the opening/closing gear 91, the cam member moves forward through the link member 131 to move the drive side coupling 115 from the non-coupling position to the coupling position. Thus, the drive side coupling 115 is engaged with the container side coupling 75, and the rotating force of the drive source can be transmitted to the agitating paddle 55 and the supply screw 53.

When the discharge tray 17 is completely turned to the opened position described above, the toner container 41 is stored in the corresponding individual storage part, and the toner can be supplied from the toner container 41. On the other hand, when the discharge tray 17 is not turned to the normal opened position, the opening/closing gear 91 is not rotated to the initial posture.

Figure 9A:
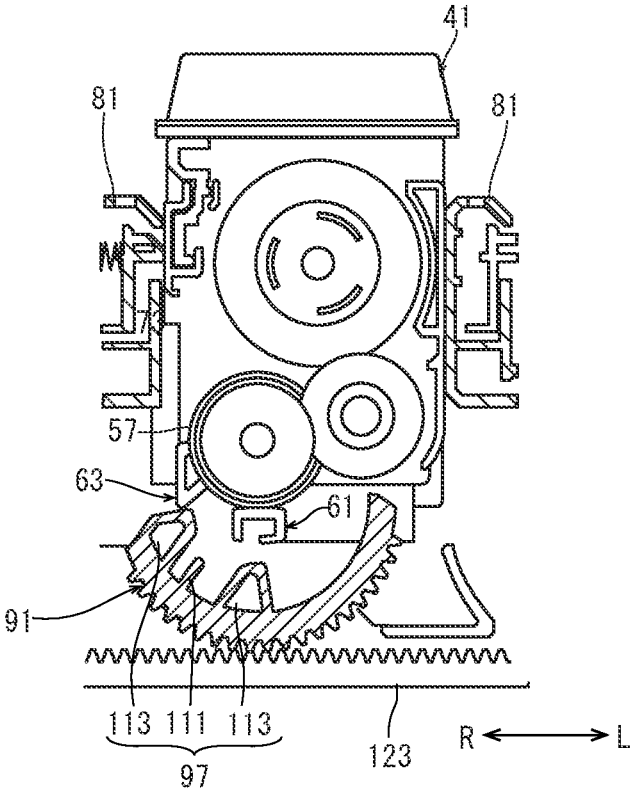
FIG. 9A is a view showing the toner container and the opening/closing gear in a state where the discharge tray is not turned to the closed position fully, in the image forming apparatus according to the embodiment of the present disclosure.
Figure 9B:
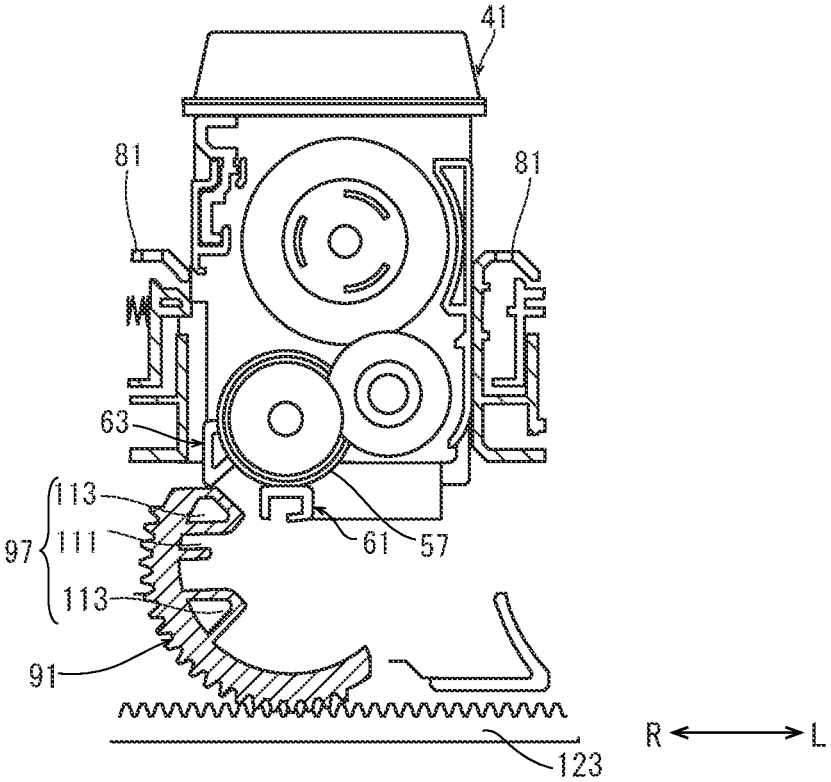
FIG. 9B is a view showing the toner container and the opening/closing gear in a state where the discharge tray is not turned to the opened position fully, in the image forming apparatus according to the embodiment of the present disclosure.

For example, as shown in FIG. 9A and FIG. 9B, in a case where the opening/closing gear 91 is not rotated to the initial posture, that is, the engagement piece 111 is not rotated to the lowest position, when the toner container 41 is inserted into the individual storage part, the interference projection 63 of the shutter 57 comes into contact with the guide piece 113 of the opening/closing gear 91 to make it impossible for the toner container to be moved downward. That is, the toner container 41 is not completely attached to the container storage part 43, and is lifted to some extent above the container storage part 43. As described above, the interference protrusion 63 of the shutter 57 is an example of an interference portion that prevents the toner container 41 from being attached to the container storage part 43 when the discharge tray 17 is not disposed in the normally opened position.

The user can easily and visually confirm that the toner container 41 is lifted above the container storage part 43. Further, when the discharge tray 17 is closed, the discharge tray 17 interferes with the lifted toner container 41. Thus, this makes the user notice that the toner container 41 is not properly attached. Then, for example, after the user detaches the toner container 41 temporarily, he correctly turns the discharge tray 17 to the opened position to reattach the toner container 41.

Figure 10:
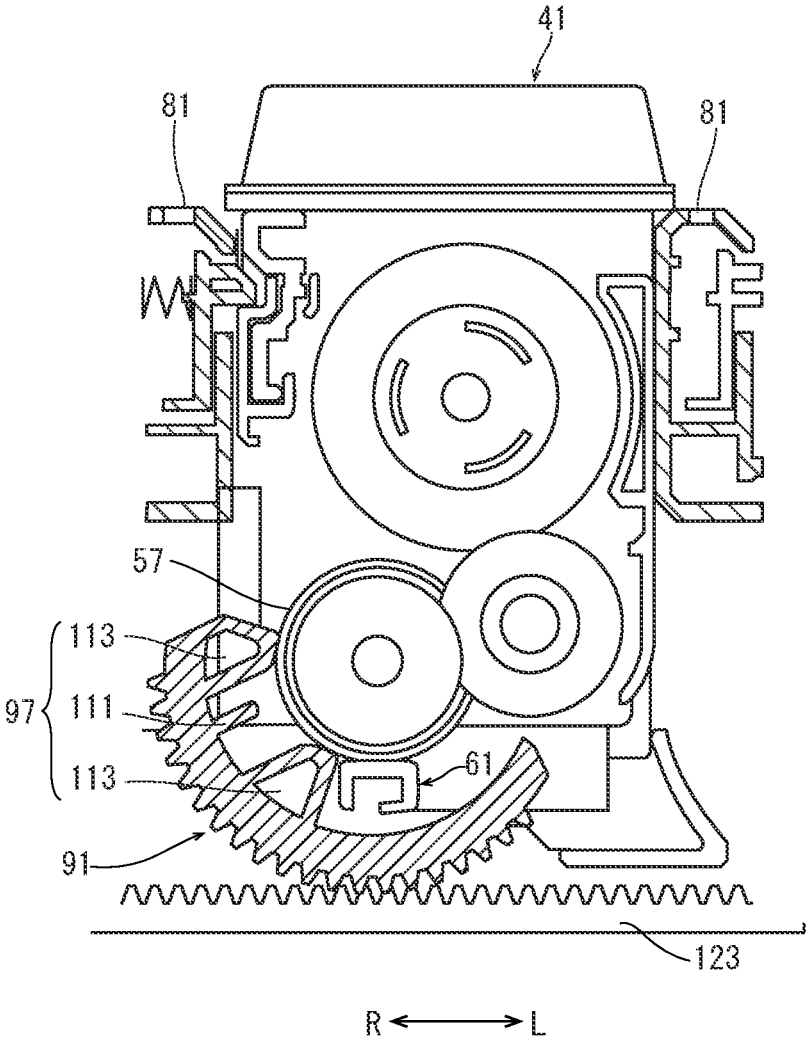
FIG. 10 is a view showing the toner container and the opening/closing gear in a state where the discharge tray is not turned to the opening state fully, in a case where the shutter is not provided with an interference protrusion.

If the shutter 57 is not provided with the interference projection 63, even in a case where the discharge tray 17 is not turned to the normal opened position as shown in FIG. 10, the toner container 41 may be attached to the container storage part 43. In this case, since the engagement protrusion 61 of the shutter 57 is not engaged with the engagement protrusion 97 of the opening/closing gear 91, even if the discharge tray 17 is turned to the closed position, the shutter 57 is not rotated and the supply port of the toner container 41 is not opened. If the image forming operation is carried out in such a state, the toner is not supplied from the toner container 41 to the developing unit 31, and problems such as insufficient image density may occur.

As is clear from the above description, according to the present disclosure, in a case where the discharge tray 17 is not turned to the normal opened position, the toner container 41 interferes with the opening/closing gear 91, and the toner container 41 cannot be attached to the container storage part 43. In other words, it is possible to prevent the toner container 41 from being attached to the container storage part 43 under a state where the discharge tray 17 is half-opened. In a state where the toner container 41 interferes with the opening/closing gear 91, the toner container is lifted above the container storage part 43 (the housing 3), so that the user can easily and visually confirm whether the toner container 41 is lifted. Further, when the toner container 41 is lifted above the container storage part 43, the discharge tray 17 cannot be turned to the closed position. Therefore, the user can surely confirm that the toner container 41 is not correctly attached to the container storage part 43 (the incorrect attachment).

Further, by providing the interference projection 63 in the shutter 57, the attaching of the toner container 41 in a state where the discharge tray 17 is half-opened can be prevented by using the guide piece 113 originally provided in the opening/closing gear 91.

Further, since the drive side coupling 115 and the container side coupling 75 can be coupled or uncoupled in accordance with the rotating of the opening/closing gear 91, the constitution of the transmission mechanism of the rotating force to the agitating paddle 55 and the supply screw 53 of the toner container 41 can be simplified.

The above embodiment shows an example where the interference projection 63 is provided in the shutter 57 of the toner container 41, but the interference projection 63 may be provided in the housing 51 of the toner container 41. However, in the present disclosure, since the shutter 57 and the opening/closing gear 91 are engaged with each other when the toner container 41 is attached to the container storage part 43, by providing the interference projection 63 in the shutter 57, the interference projection 63 can be reliably brought into contact with the opening/closing gear 91 when the discharge tray 17 is not turned to the normal opened position.

The above embodiment shows an example where the discharge tray 17 as a cover is turned to the opened position and to the closed position, but the cover may be moved in the upper-and-lower direction to the opened position and to the closed position. In this case, the cover may be provided with a rack gear along the upper-and-lower direction, and the rack gear may be meshed with the rack gear 123 of the opening/closing mechanism through a pinion gear. By moving the cover in the upper-and-lower direction, the rack gear moves in the upper-and-lower direction, and the rack gear 123 can be moved in the horizontal direction through the pinion gear.

Although the present disclosure has been described with respect to specific embodiments, the present disclosure is not limited to the above embodiments. Those skilled in the art will be able to modify the above embodiments without departing from the scope and intent of the present disclosure.

The invention claimed is:

1. An image forming apparatus comprising:

a toner container including a shutter which is rotated to open and close a supply port for a toner;

a storage part to which the toner container is detachably attached along a predetermined direction;

a cover which is movable between a closed position for closing the storage part and an opened position for opening the storage part; and an opening/closing mechanism configured to close the supply port by rotating the shutter in one direction in accordance with an opening operation for moving the cover to the opened position and to open the supply port by rotating the shutter in the other direction in accordance with a closing operation for moving the cover to the closed position, in a state where the toner container is attached to the storage part, wherein the toner container includes an interference portion which interferes with the opening/closing mechanism to prevent the toner container from being attached to the storage part in a case where the cover is not moved to the opened position normally.

2. The image forming apparatus according to claim 1, wherein, the opening/closing mechanism includes:

a rack gear which is moved in accordance with the opening and closing operations of the cover; and an opening/closing gear which is rotated in mesh with the rack gear and is engaged with the shutter when the toner container is attached to the storage part, and the rack gear is moved in one direction to rotate the shutter in one direction through the opening/closing gear to close the supply port at the opening operation of the cover, and is moved in a direction opposite to the one direction to rotate the shutter in the other direction through the opening/closing gear to open the supply port at the closing operation of the cover, wherein the interference portion is an interference protrusion which is provided in the shutter and can interfere with the opening/closing gear.

3. The image forming apparatus according to claim 2, wherein the shutter has an engagement protrusion, the opening/closing gear includes an engagement piece engageable with the engagement protrusion and a pair of guide pieces provided on both sides of the engagement piece in a rotating direction of the opening/closing gear, and the interference protrusion of the shutter can interfere with one of the pair of guide pieces of the opening/closing gear.

4. The image forming apparatus according to claim 3, wherein, the engagement protrusion and the interference protrusion are spaced apart from each other in a circumferential direction of the shutter, and when the engagement protrusion of the shutter is engaged with the engagement piece of the opening/closing gear, one of the pair of guide pieces of the opening/closing gear is fitted between the engagement protrusion and the interference protrusion of the shutter.

5. The image forming apparatus according to claim 3, wherein, the engagement protrusion of the shutter has a rectangular cylindrical shape which is long in the circumferential direction of the shutter and has a slit along an axial direction of the shutter, and when the engagement piece of the opening/closing gear is engaged with the engagement protrusion of the shutter, the engagement piece is elastically deformed when the engagement piece enters the slit, and after the engagement piece enters the slit, the engagement piece is elastically returned and gives a user a click feeling.

6. The image forming apparatus according to claim 2, wherein, the toner container includes:

a supply screw which is rotated to supply the toner through the supply port; and a container side coupling provided in the supply screw; and the storage part includes:

a drive side coupling connected to a drive source for rotating the supply screw and movable to a coupling position capable of coupling to the container side coupling and a non-coupling position releasing the coupling to the container side coupling; and a link member connecting the drive side coupling and the opening/closing gear, wherein when the cover is moved to the opened position, the drive side coupling is moved to the non-coupling position through the link member, and when the cover is moved to the closed position, the drive side coupling is moved to the coupling position through the link member.

* * * * *